US007722021B2

(12) United States Patent
Sasahara

(10) Patent No.: US 7,722,021 B2
(45) Date of Patent: May 25, 2010

(54) SHEET PROCESSING APPARATUS

(75) Inventor: Katsuya Sasahara, Izu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 577 days.

(21) Appl. No.: 11/684,268

(22) Filed: Mar. 9, 2007

(65) Prior Publication Data

US 2008/0217834 A1 Sep. 11, 2008

(51) Int. Cl.
*B65H 37/04* (2006.01)

(52) U.S. Cl. ..... 270/37; 270/32; 270/45; 270/51; 270/58.07

(58) Field of Classification Search ..... 270/32, 270/37, 45, 51, 58.07; 493/415, 435
See application file for complete search history.

(56) References Cited

U.S. PATENT DOCUMENTS 6,004,254 A * 12/1999 Murata ..... 493/444
6,921,069 B2 * 7/2005 Suzuki et al. ..... 271/207

FOREIGN PATENT DOCUMENTS

| | | |
|---|---|---|
| JP | 62-16987 | 1/1987 |
| JP | 2004-059304 | 2/2004 |
| JP | 2004-106991 | 4/2004 |
| JP | 2005-162345 | 6/2005 |

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet processing apparatus of the invention includes a folding mechanism that includes paired folding rollers, presses a sheet to a nip portion of the paired folding rollers from a direction orthogonal to a transport direction, and folds the sheet by rotating the paired folding rollers. Further, there are provided a drive motor capable of making positive rotation and reverse rotation, a variable speed mechanism to convert a rotation force of the drive motor into a rotation output in a single direction and with a low speed or a high speed by changing a rotation direction of the drive motor, a transmission mechanism to transmit the rotation output in the single direction to the paired folding rollers, and a control unit to control the rotation direction of the drive motor and to change the rotation speed of the paired folding rollers.

6 Claims, 7 Drawing Sheets

SHEET PROCESSING APPARATUS

BACKGROUND OF THE INVENTION

1. Field of the Invention

The present invention relates to a sheet processing apparatus to perform a post-processing on sheets discharged from an image forming apparatus such as a copier, a printer or a multi function peripheral (MFP).

2. Description of the Related Art

In recent years, among image forming apparatuses, there is one in which a sheet post-processing apparatus is provided to be adjacent to an image forming apparatus main body, so that a post-processing is performed, for example, sheets after image formation are sorted or the sheet are subjected to staple processing. Besides, there is also one in which a sheet bundle is folded in two and is discharged.

JP-A-62-16987 discloses a paper folding apparatus. In this example, there are included a pair of rollers and a folding piece, a sheet is pushed toward a nip side of the paired rollers by the folding piece, and the sheet is folded. Further, there is provided a roller to again press the folded sheet and to additionally fold it.

Besides, JP-A-2004-59304 discloses a sheet processing apparatus including paired folding rollers to fold a sheet and an additional folding roller to additionally fold the sheet. In this example, a mechanism to reduce the noise caused by the additional roller is disclosed.

Further, JP-A-2004-106991 discloses a sheet processing apparatus including paired folding rollers to fold a sheet bundle and an additional folding roller to again press the folded part of the sheet and to additionally fold it. In this example, there is provided control means for determining whether or not additional folding is performed according to the number of sheets.

Besides, JP-A-2005-162345 also discloses a sheet processing apparatus including paired folding rollers to fold a sheet bundle and an additional folding roller to again press the folded part of the sheet and to additionally fold it. In this example, there is disclosed a mechanism to uniformly press the folded part of the sheet by the additional roller.

However, in any of the above-described four examples, the structure is such that the additional folding device is added, and there have been defects that the structure is complicated, and it takes much time to perform the operation of the sheet folding.

The invention provides a sheet processing apparatus including a finisher having a sheet folding mechanism and improved in efficiency of sheet folding operation.

DETAILED DESCRIPTION OF THE INVENTION

Figure 1:
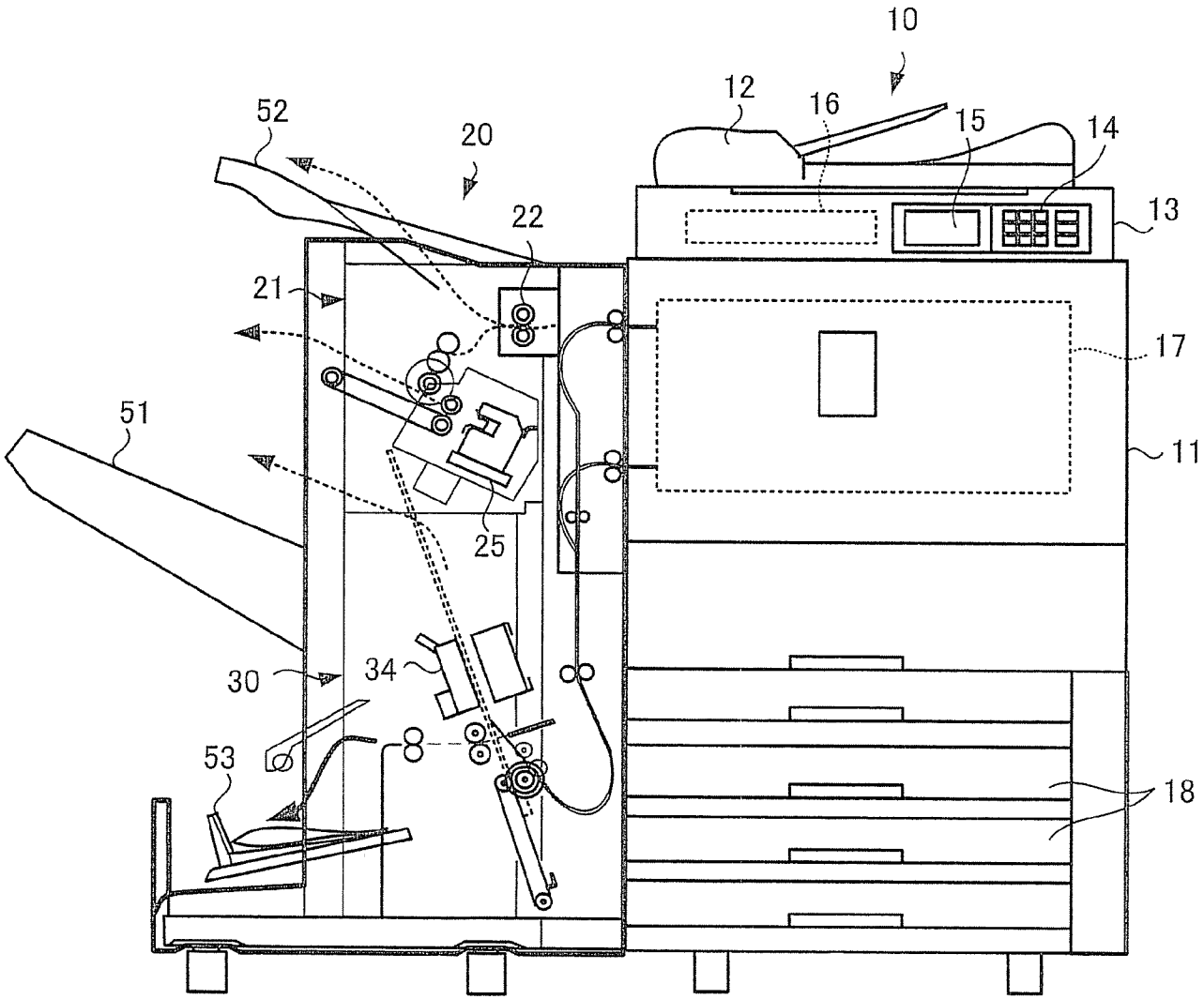
FIG. 1 is a schematic structural view showing a sheet processing apparatus according to an embodiment of the invention.

Throughout this description, the embodiments and examples shown should be considered as exemplars, rather than limitations on the apparatus of the present invention.

Hereinafter, embodiments of the invention will be described in detail with reference to the drawings. Incidentally, in the respective drawings, the same portions are denoted by the same reference numerals and will be described.

FIG. 1 is a structural view showing an embodiment of a sheet processing apparatus of the invention. In FIG. 1, reference numeral 10 denotes an image forming apparatus which is, for example, an MFP (Multi-Function Peripherals) as a compound machine, a printer, a copier or the like. A sheet processing apparatus 20 is disposed to be adjacent to the image forming apparatus 10. A sheet on which an image is formed by the image forming apparatus 10 is transported to the sheet processing apparatus 20.

The sheet processing apparatus 20 performs a post-processing on the sheet supplied from the image forming apparatus 10, and performs, for example, a sort processing or a staple processing. Besides, as the need arises, the sheet is folded in two and is discharged. Since the sheet processing apparatus 20 is generally called a finisher, in the following description, there is also a case where it is called the finisher 20.

In FIG. 1, a document table (not shown) is provided in the upper part of a main body 11 of the image forming apparatus 10, and an automatic document feeder (ADF) 12 is openably and closably provided on the document table. Further, an operation panel 13 is provided in the upper part of the main body 11. The operation panel 13 includes an operation unit 14 having various keys and a display unit 15 of touch panel type.

A scanner unit 16 and a printer unit 17 are included in the inside of the main body 11, and a plurality of cassettes 18 containing various sizes of sheets are provided in the lower part of the main body 11. The scanner unit 16 reads a document sent by the ADF 12 or a document placed on the document table.

The printer unit 17 includes a photoconductive drum, a laser and the like, the surface of the photoconductive drum is scanned and exposed by a laser beam from the laser, and an electrostatic latent image is formed on the photoconductive drum. A charging unit, a developing unit, a transfer unit and the like are arranged around the photoconductive drum, the electrostatic latent image on the photoconductive drum is developed by the developing unit, and a toner image is formed on the photoconductive drum. The toner image is transferred to a sheet by the transfer unit. The structure of the printer 17 is not limited to the foregoing example, and there are various systems.

The finisher 20 includes a staple mechanism 21 to perform a staple processing on a sheet bundle, a saddle stitcher 30 to perform a sheet folding processing, a paper discharge tray 51 and a fixed tray 52. The paper discharge tray 51 is of a movable type, and receives a sheet bundle subjected to the staple processing. The staple mechanism 21 includes an aligning device to align the transported sheets in the width direction, and the sheets can be sorted and discharged by using this aligning device.

Incidentally, in the case where the post-processing such as stapling is not performed, the sheet transported from the image forming apparatus 10 is discharged to the paper discharge tray 51 or the fixed tray 52 without being subjected to any processing.

Figure 2:
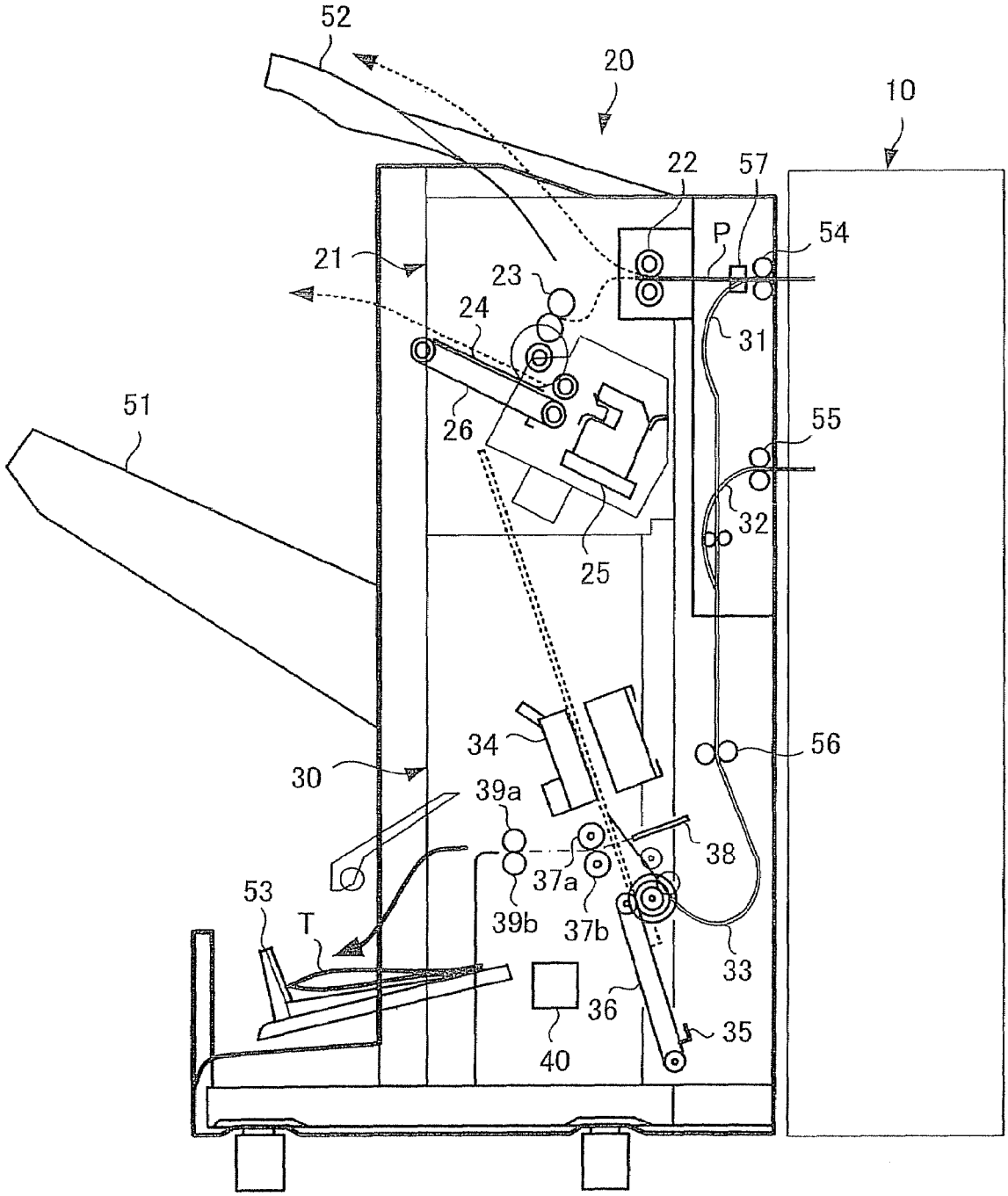
FIG. 2 is an enlarged structural view showing a structure of a main part of the sheet processing apparatus of the invention.

The structure of the finisher 20 is enlarged and shown in FIG. 2. First, the staple mechanism 21 of the finisher 20 will be described in brief. A sheet P supplied from the image forming apparatus 10 is received by entrance rollers 22 provided near the carry-in entrance of the finisher 20. Paper feed rollers 23 are provided at the downstream side of the entrance rollers 22, and the sheet P received by the entrance rollers 22 is stacked on a processing tray 24 through the paper feed rollers 23 and the like.

The sheet stacked on the processing tray 24 is guided to a stapler 25, and a staple processing is performed. Besides, in order to transport the sheet P subjected to the sort processing or the staple processing to the paper discharge tray 51, a transport belt 26 is provided.

The sheet P transported by the transport belt 26 is discharged to the paper discharge tray 51, and the paper discharge tray 51 is moved up or down by a drive unit (not shown) and receives the sheet P.

Besides, there is also a case where the sheet P is discharged to the paper discharge tray 51 without being subjected to the staple processing. In this case, the sheet P is discharged without being dropped to the processing tray 24. Besides, the sheet P not requiring the post-processing can also be discharged to the fixed tray 52. Although a transport path to guide the sheet P to the fixed tray 52 is provided, its illustration is omitted.

Next, the structure of the saddle stitcher 30 will be described.

The saddle stitcher 30 is an apparatus to bundle sheets supplied from the image forming apparatus 10 and to fold them in two.

The sheet P transported from the image forming apparatus 10 is transported through a paper path 31 or 32, is further transported in a direction toward a stapler 34 through a paper path 33, and is once received by a stack tray 35. The sheets P transported are sequentially stacked on the stack tray 35 to form a sheet bundle, and a staple is applied to its center part.

A sheet bundle T subjected to the staple processing by the stapler 34 is moved down by a guide belt 36, and is stopped at a position where the center part of the sheet bundle T comes to a nip point of paired folding rollers 37*a* and 37*b*. A blade 38 is disposed at a position opposite to the paired folding rollers 37*a* and 37*b*.

The blade 38 protrudes the center part of the sheet bundle T to the nip point of the paired folding rollers 37*a* and 37*b* and pushes the sheet bundle T into between the folding rollers 37*a* and 37*b*. Thereafter, the paired folding rollers 37*a* and 37*b* rotate while folding and nipping the sheet bundle T, and fold the sheet bundle T in two. The sheet bundle T folded in two is transported by paired discharging rollers 39*a* and 39*b*, and is discharged to the paper discharge tray 53.

Figure 6:
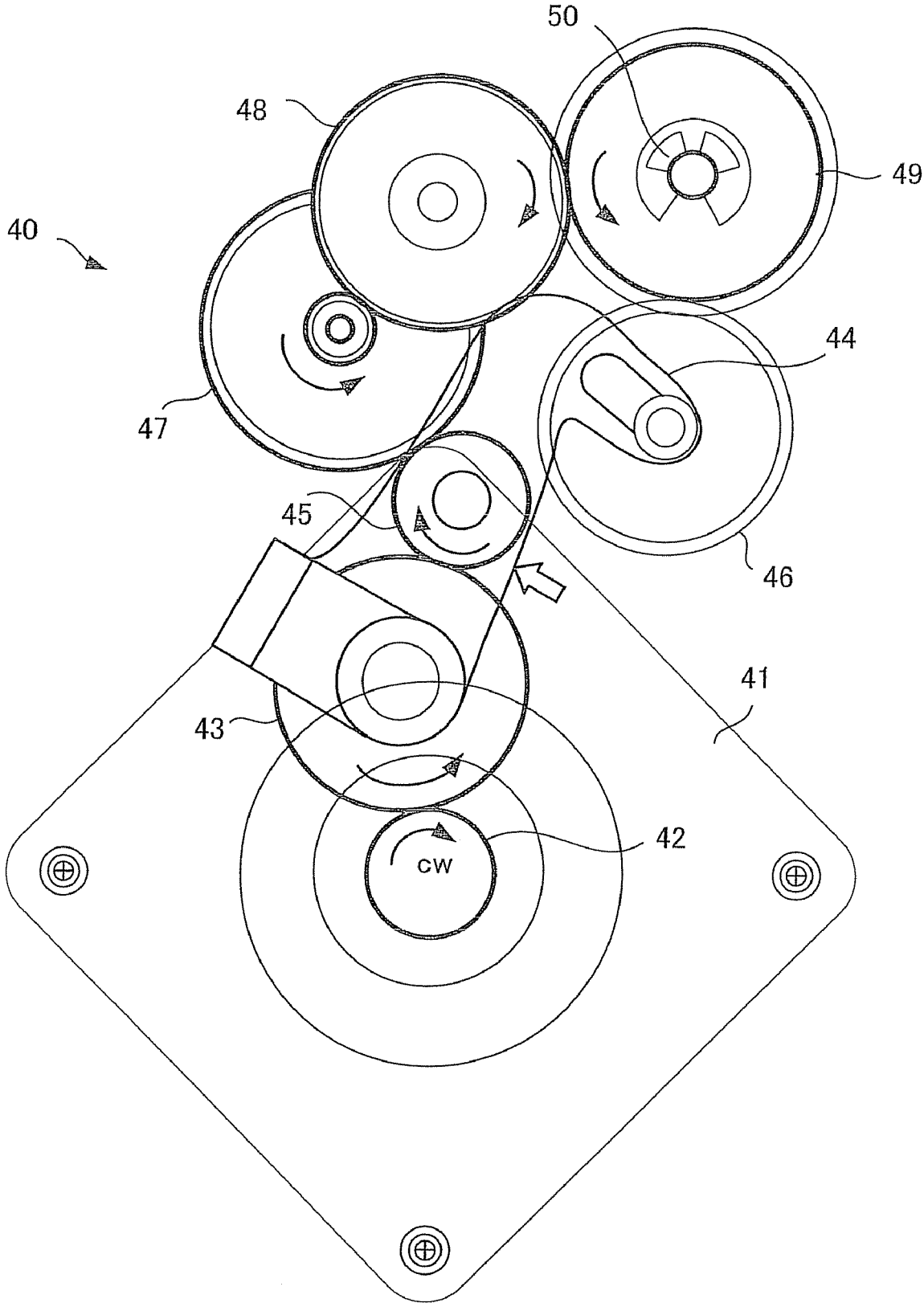
FIG. 6 is a front view showing a variable speed mechanism used in the sheet processing apparatus of the invention.

Besides, a variable speed device 40 is provided in order to rotation-drive the folding rollers 37*a* and 37*b* and the paired discharging rollers 39*a* and 39*b*. The variable speed device 40 is shown in FIG. 6 and will be described later.

Incidentally, guide rollers 54, 55 and 56 are provided in order to guide the sheet P supplied from the image forming apparatus 10 along the paper paths 31, 32 and 33. Besides, a gate 57 is provided at the outlet of the guide roller 54 in order to change the transport of the sheet P supplied from the image forming apparatus 10 to the staple mechanism 21 side or the saddle stitcher 30 side.

In the case where the sheet folding processing is not performed, the gate 57 transports the sheet P discharged from the image forming apparatus 10 to the rollers 22 of the staple mechanism 21. In the case where the sheet folding processing is performed, the sheet P is transported to the saddle stitcher 30.

Figure 3:
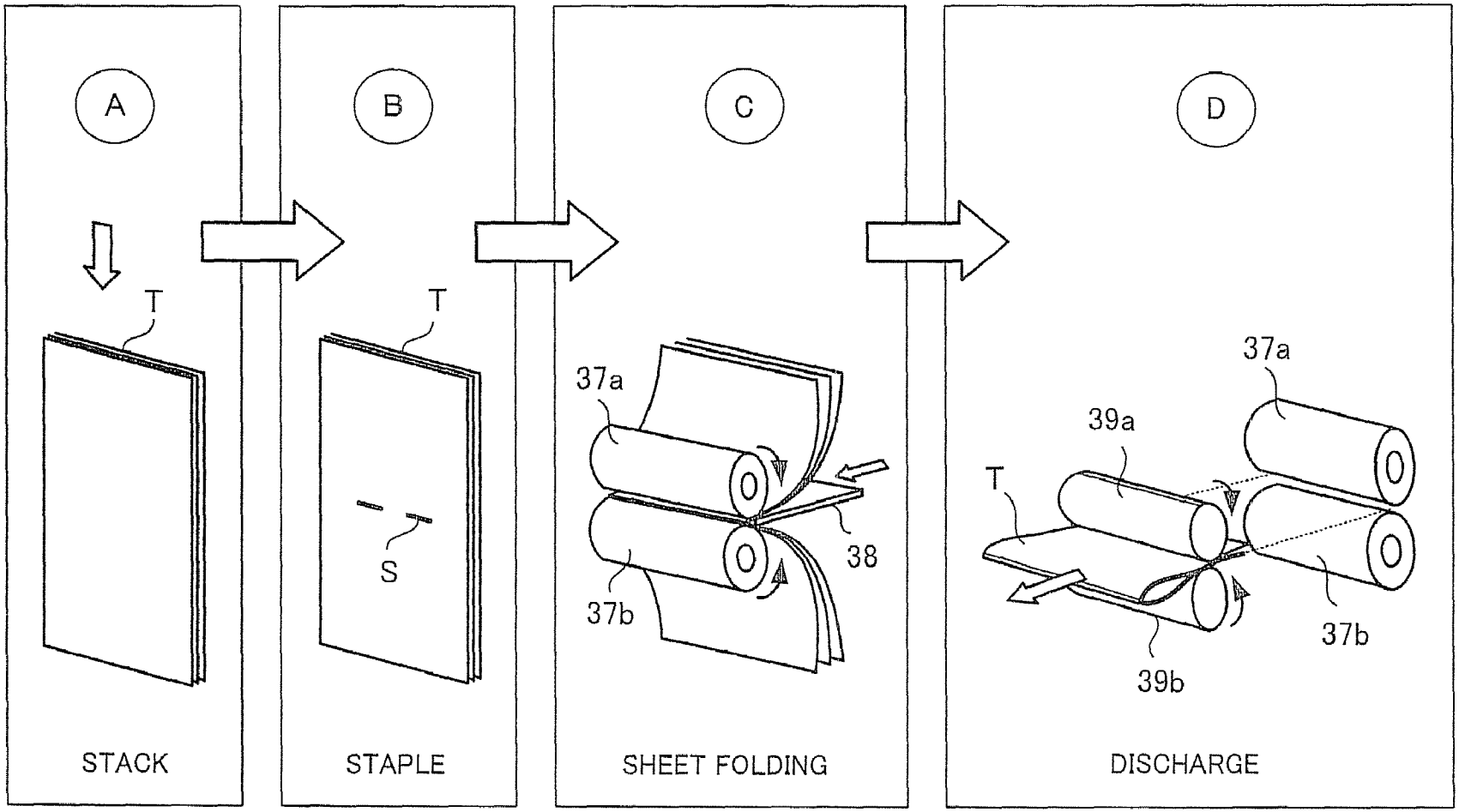
FIG. 3 is an explanatory view for explaining a flow of a sheet folding processing in the sheet processing apparatus of the invention.

FIG. 3 is a flowchart for schematically explaining the operation of the saddle stitcher 30, and the sheet P is processed in the order shown by A to D.

In FIG. 3, the sheet P discharged from the image forming apparatus 10 is transported through the paper path 33 and is received by the stack tray 35 before being sent to the stapler 34. As indicated by A, the sequentially transported sheets P are stacked on the stack tray 35, and are aligned as the sheet bundle T.

The stapler 34 applies a staple S to the center part of the sheet bundle T. Character B indicates the sheet bundle T to which the staple S is applied.

Thereafter, the sheet bundle T to which the staple S is applied is moved down by the guide belt 36. When the center part of the sheet bundle T comes to the nip point of the paired folding rollers 37*a* and 37*b*, as indicated by C, the blade 38 protrudes the center part of the sheet bundle T to the nip point of the paired folding rollers 37*a* and 37*b*, and pushes it into between the folding rollers 37*a* and 37*b*. The paired rollers 37*a* and 37*b* rotates so as to draw in the sheet bundle T, so that the sheet bundle T is folded and is discharged.

The sheet bundle T folded in two is transported by the paired discharging rollers 39*a* and 39*b* as indicated by D, and is discharged to the paper discharge tray 53.

Figure 4A:
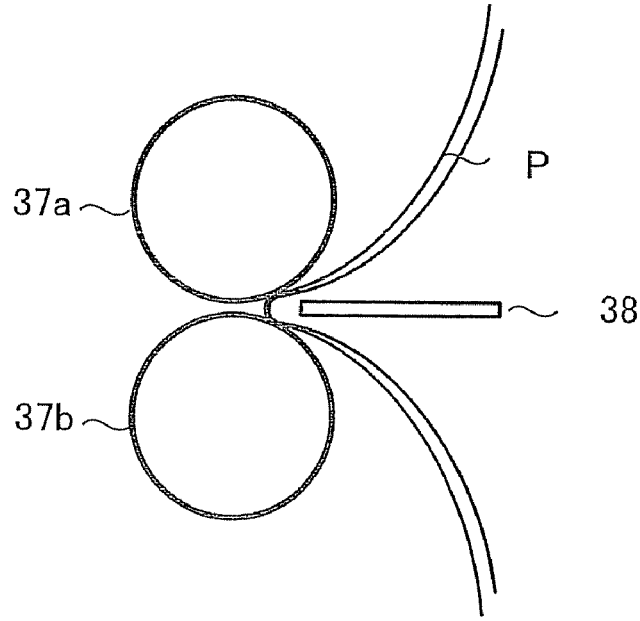
FIG. 4 is an explanatory view for explaining an operation of sheet folding rollers in the sheet processing apparatus of the invention.
Figure 4B:
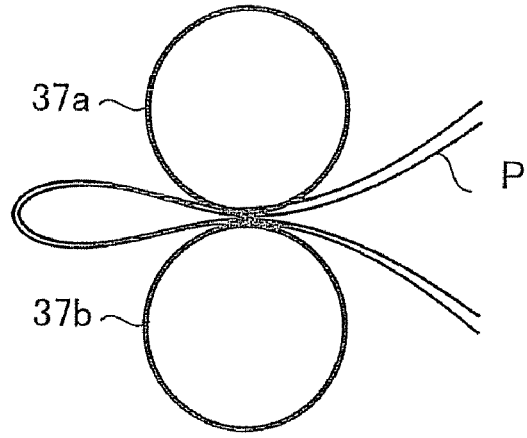
Figure 4C:
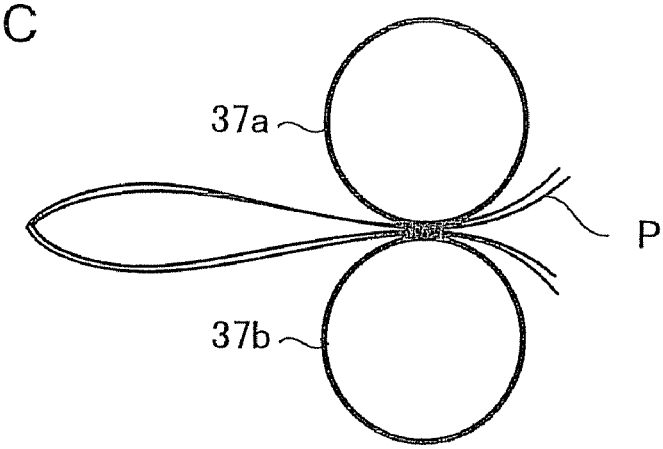

FIGS. 4A, 4B and 4C are views for explaining, in more detail, the operation at the time of the folding processing of the sheet bundle T by the paired folding rollers 37*a* and 37*b*.

As shown in FIG. 4A, when the center part of the sheet bundle T is protruded to the nip point of the paired folding rollers 37*a* and 37*b* by the blade 38, the folding rollers 37*a* and 37*b* starts to rotate. At this time, since the load of a motor 41 (see FIGS. 5 and 6) to drive the paired folding rollers 37*a* and 37*b* becomes heavy, it is necessary that the folding rollers 37*a* and 37*b* are rotated at a low speed to certainly crease the sheet bundle T.

Besides, as shown in FIG. 4B, when the folded point of the sheet bundle T comes off from the paired folding rollers 37*a* and 37*b*, the load of the drive motor 41 becomes light. Further, as shown in FIG. 4C, when the end of the sheet bundle T passes through the paired folding rollers 37*a* and 37*b*, the load is further reduced.

Accordingly, in the case where the paired rollers 37*a* and 37*b* are rotated at a low speed, although the fold can be accurately formed, the discharge speed of the sheet bundle T becomes low. On the other hand, in the case where the paired rollers 37*a* and 37*b* are rotated at a high speed, although the discharge speed of the sheet bundle T becomes high, the function is lost due to lack of the torque, or the fold can not be accurately formed.

In the invention, at the initial stage of the folding processing, the paired folding rollers 37*a* and 37*b* are rotated at a low speed, and when the folded point of the sheet bundle T comes off from the paired folding rollers 37*a* and 37*b*, the paired folding rollers 37*a* and 37*b* are rotated at a high speed. Besides, the paired folding rollers 37*a* and 37*b* can be rotated in the low speed or high speed mode by merely changing the rotation direction of the drive motor 41.

Figure 5:
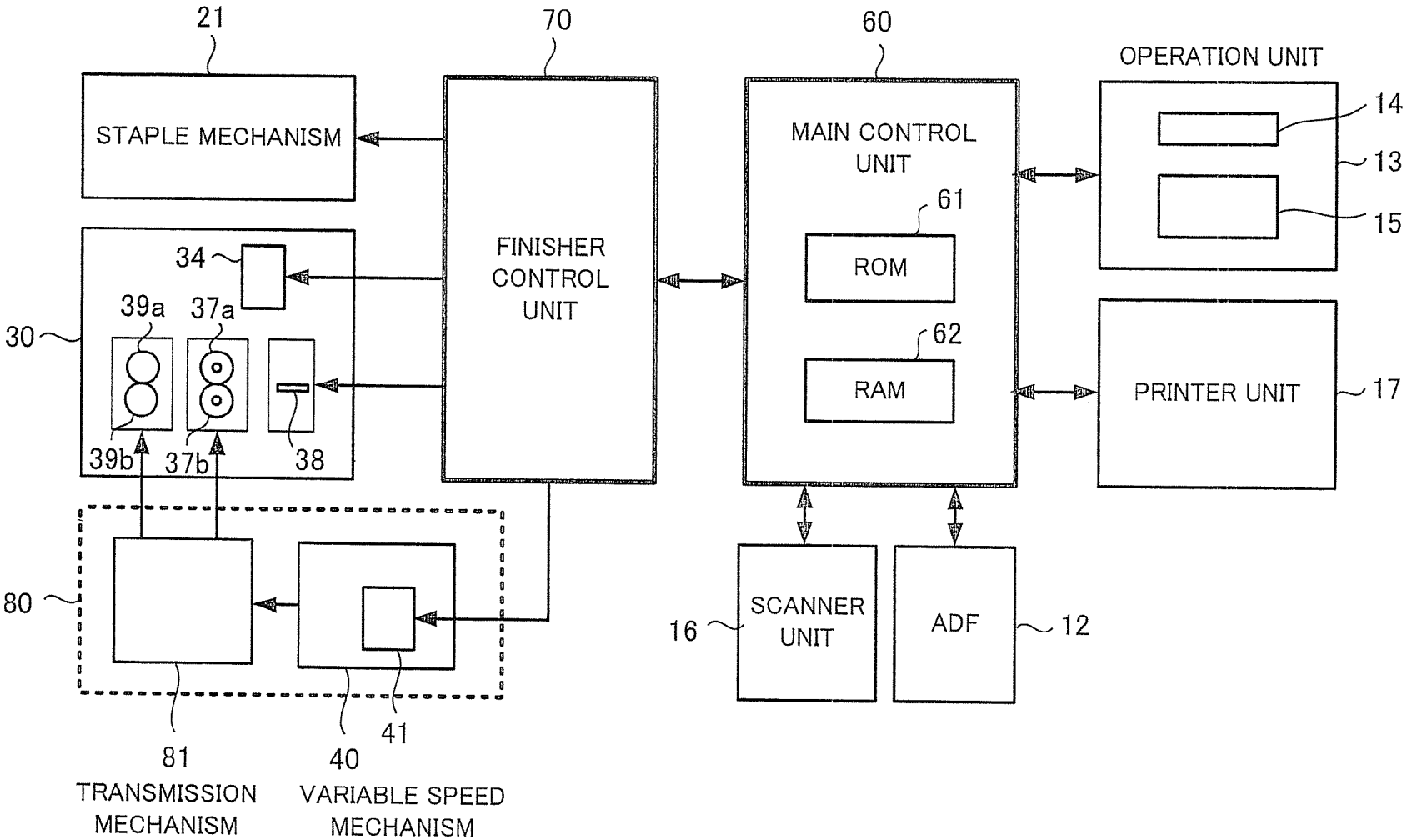
FIG. 5 is a block diagram showing a control system of the sheet processing apparatus of the invention.

In order to realize the rotation control as stated above, the sheet processing apparatus of the invention includes a control system of FIG. 5.

In the block diagram of FIG. 5, a main control unit 60 includes a CPU, a ROM 61 and a RAM 62, and controls the image forming apparatus 10 in accordance with a control program stored in the ROM 61. The main control unit 60 controls the operation of the ADF 12, the scanner unit 16 and the printer unit 17 in response to the operation from the operation panel 13. The RAM 62 temporarily stores the control data or is used for arithmetic operation at the time of control.

The operation panel 13 includes the operation unit 14 having the plurality of keys and the display unit 15 used also as the touch panel, and can give various instructions for image formation. For example, the instruction of the number of copies is performed by using the operation unit 14, and the instruction of sheet size, sheet type or stapling, the instruction of sheet folding, and the like are performed by operating the touch panel of the display unit 15.

A finisher control unit 70 controls the operation of the finisher 20. The finisher control unit 70 is connected to the main control unit 60, and transmits and receives information to and from the main control unit 60, and the image forming apparatus 10 and the finisher 20 operate in cooperation with each other.

The finisher control unit 70 controls the staple mechanism 21 and the saddle stitcher 30, respectively. The control of the staple mechanism 21 includes execution of stapling by the stapler 25, transport of the sheet P to the stapler 25, discharge of the sheet after stapling, and the like.

The control of the saddle stitcher 30 includes transport of the sheet P through the paper path 33, movement and positioning of the sheet bundle T by the guide belt 36, execution of stapling by the stapler 34, and protruding of the folding blade 38. Further, a control mechanism 80 is provided for rotation control of the folding rollers 37*a* and 37*b* and the discharging rollers 39*a* and 39*b*.

The control mechanism 80 includes the variable speed mechanism 40 and a transmission mechanism 81, and the variable speed mechanism 40 includes the drive motor 41. The drive motor 41 rotates in a first direction or an opposite second direction by the control of the control unit 70. Hereinafter, the state of rotation in the first direction is called a positive rotation, and the state of rotation in the second direction is called a reverse rotation.

The drive motor 41 is a drive source for rotating the folding rollers 37*a* and 37*b* and the discharging rollers 39*a* and 39*b*. The variable speed mechanism 40 is for obtaining rotation outputs in a single direction, which are different from each other in reduction ratio, by the positive rotation and the reverse rotation of the drive motor 41. The transmission mechanism 81 is for transmitting the rotation output in the single direction to the folding rollers 37*a* and 37*b* and the discharging rollers 39*a* and 39*b*.

When the drive motor 41 makes the positive rotation, the rotation output with a low rotation speed is obtained from the variable speed mechanism 40, and when the drive motor 41 makes the reverse rotation, the rotation output with a high rotation speed is obtained from the variable speed mechanism 40. In either case, the rotation output in the same direction is obtained from the variable speed mechanism 40.

The transmission mechanism 81 is constructed of a general gear, a belt and the like, and is for rotating the folding rollers 37*a* and 37*b* and the discharging rollers 39*a* and 39*b* at a rotation speed in proportion to the rotation output in the single direction.

Accordingly, by using the rotation output in the single direction from the variable speed mechanism 40, the paired folding rollers 37*a* and 37*b* are rotated at the low speed at the initial stage of the folding processing of the sheet bundle T, and when the folded point of the sheet bundle T comes off from the paired folding rollers 37*a* and 37*b*, the paired folding rollers 37*a* and 37*b* can be rotated at the high speed.

FIG. 6 is a front view for explaining the structure of the variable speed mechanism 40.

The variable speed mechanism 40 includes the drive motor 41, a first gear 43 engaged with and rotated by a motor shaft 42 of the drive motor 41, a lever 44 rotated around a rotation shaft of the first gear 43, and a planetary gear 45 attached to the lever 44 and engaged with and rotated by the first gear 43.

Further, there are included a second gear 46 and a third gear 47 engaged with and rotated by the planetary gear 45, a fourth gear 48 engaged with and rotated by the third gear 47, and a fifth gear 49 engaged with and rotated by the second gear 46 or the fourth gear 48. The fifth gear 49 is provided integrally with a rotation shaft 50, and the rotation shaft 50 rotates in the single direction.

The lever 44 rotates in the rotation direction of the first gear 43 and is changed so that the planetary gear 45 engages with either one of the second gear 46 and the third gear 47. For example, when the first gear 43 rotates in the left direction of the drawing, the lever 44 also rotates in the left direction, and the planetary gear 45 engages with the third gear 47. When the first gear 43 rotates in the right direction, the lever 44 also rotates in the right direction, and the planetary gear 45 engages with the second gear 46.

The third and the fourth gears 47 and 48 constitute a reduction gear.

Next, the operation of the variable speed mechanism 40 will be described. When the variable speed mechanism 40 is in the state of FIG. 6, that is, when the motor 41 rotates in the first direction (clockwise direction cw), since the first gear 43 rotates in the reverse direction, the lever 44 rotates toward the third gear 47.

Thus, the rotation force of the motor 41 is transmitted to the fifth gear 49 through the first gear 46, the planetary gear 45, the third gear 47 and the fourth gear 48, and the fifth gear 49 rotates in the second direction (counterclockwise direction ccW). In the state of FIG. 6, since the third and the fourth gears 47 and 48 constitute the reduction gear, the fifth gear 49 rotates at a low speed.

Figure 7:
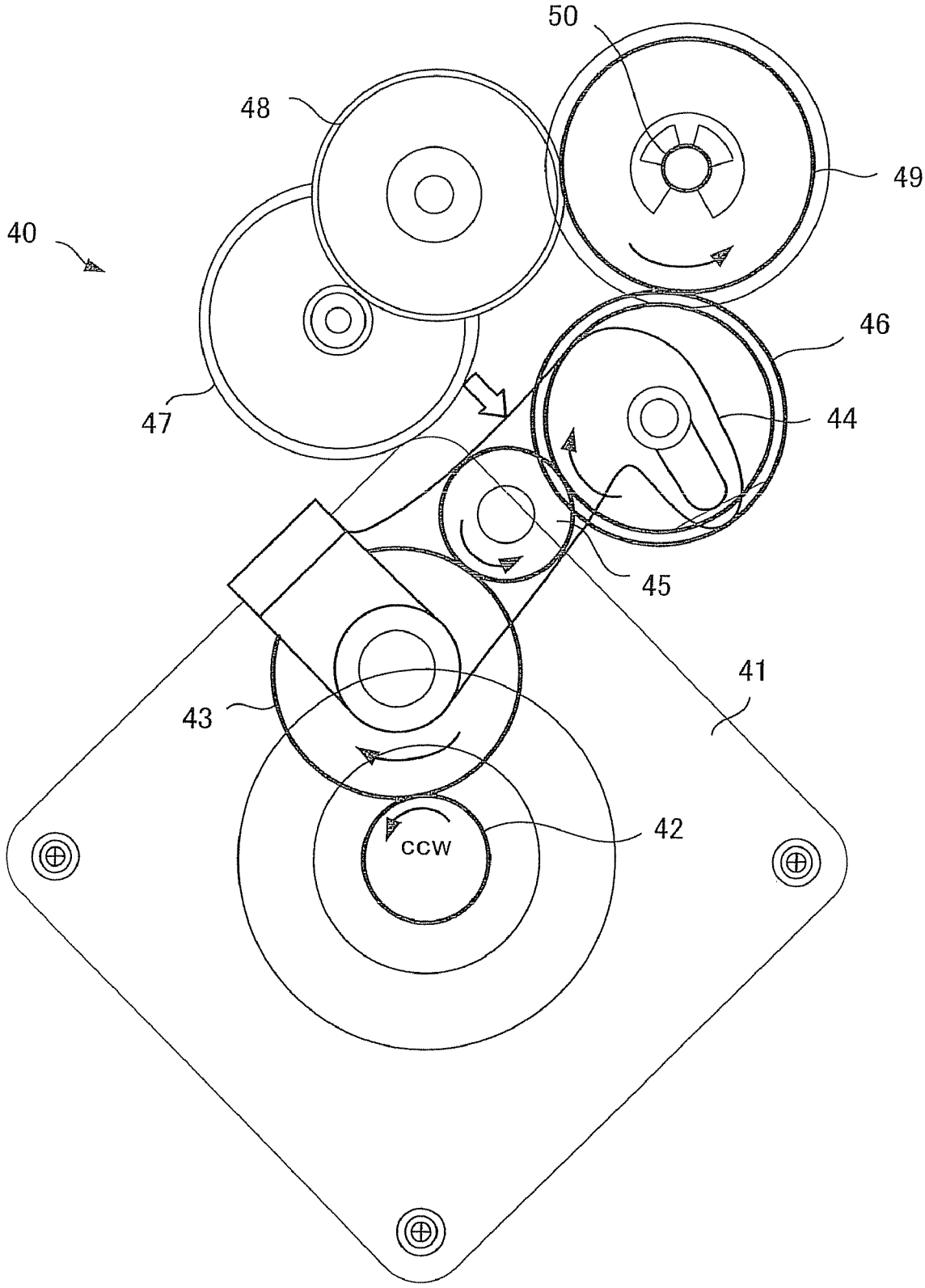
FIG. 7 is a front view for explaining an operation of the variable speed mechanism used in the sheet processing apparatus of the invention.

On the other hand, when the motor 41 rotates in the second direction (ccw), as shown in FIG. 7, since the first gear 43 rotates in the reverse direction, the lever 44 rotates toward the first gear 46.

The rotation force of the motor 41 is transmitted to the fifth gear 49 through the first gear 46, the planetary gear 45 and the second gear 46, and the fifth gear 49 rotates in the second direction (ccW). At this time, the fifth gear 49 rotates at a high speed.

As is understood from FIG. 6 and FIG. 7, the fifth gear 49 rotates in the same direction (ccw) in both the states. Accordingly, the rotation outputs in the single direction, which are different from each other in the reduction ratio, can be obtained by merely changing the rotation direction of the drive motor 41.

The rotation output of the rotation shaft 50 is transmitted to the paired folding rollers 37*a* and 37*b* and the paired discharging rollers 39*a* and 39*b* through the transmission mechanism 81. The transmission mechanism 81 includes, for example, a gear mechanism, the folding roller 37*a* rotates in the first direction (cw) in proportion to the rotation speed of the rotation shaft 50, and the folding roller 37*b* rotates in the second direction (ccW) at the same rotation speed as the folding roller 37*a*.

Besides, the paired discharging roller 39*a* rotates in the first direction (cw) at the same rotation speed as the folding roller 37*a*, and the discharge roller 39*b* rotates in the second direction (ccW) at the same rotation speed as the folding roller 37*b*. Accordingly, the paired folding rollers 37*a* and 37*b* and the paired discharging rollers 39*a* and 39*b* are rotated by the one drive motor 41 in conjunction with each other.

Incidentally, in FIG. 6, the second gear 46 idles, and in FIG. 7, the third and the fourth gears 47 and 48 idle.

The control unit 70 controls the drive motor 41 in accordance with the transport state of the sheet bundle T, and as shown in FIG. 4A, at the initial stage where the center part of the sheet bundle T is protruded to the nip point of the paired rollers 37*a* and 37*b* by the blade 38 and the folding rollers 37*a* and 37*b* starts to rotate, the drive motor 41 is rotated in the first direction (cw). By this, the paired folding rollers 37*a* and 37*b* rotates at the low speed, and the sheet bundle T can be certainly creased.

Besides, as shown in FIGS. 4B and 4C, when the folded point of the sheet bundle T comes off from the paired folding rollers 37*a* and 37*b*, the drive motor 41 is rotated in the second direction (ccW). By this, since the paired folding rollers 37*a* and 37*b* rotate at the high speed, the discharge of the sheet bundle T can be performed at the high speed.

Besides, since the discharging rollers 39*a* and 39*b* rotate in conjunction with the folding rollers 37*a* and 37*b*, the discharge operation of the sheet bundle T can be performed smoothly.

Alternatively, the discharging rollers 39*a* and 39*b* may be made to always rotate in the high speed mode and at the same speed as the rotation speed at the time when the folding rollers 37*a* and 37*b* rotate at the high speed.

Incidentally, the rotation direction of the drive motor 41 is controlled by the control unit 70, so that the sheet folding processing can be executed in various modes.

For example, in the case where the number of sheets of the sheet bundle T is small, even if the paired rollers 37*a* and 37*b* are not rotated at a low speed, the sheet bundle T can be relatively easily creased. Accordingly, in the case where the number of sheets to be subjected to the folding processing is smaller than a specified number, the drive motor 41 may be rotated only in the second direction, so that the sheet folding is performed at the high speed.

Methods of determining the number of sheets include a method of using information of the number of sheets inputted by the user through the operation panel 13, and a method of detecting sheets passing through the paper path 33 by a sensor and counting the number of sheets having passed.

Besides, since a noise level becomes high when the folding processing is performed at a high speed, in the case where the folding processing is desired to be executed at a low noise, the drive motor 41 is rotated only in the first direction. By this, since the folding processing is performed at a low speed, the folding processing can be performed in a low noise mode. For example, a mode switching button is provided on the operation panel 13, and the low noise mode is made selectable.

As described above, according to the invention, at the time of folding processing of a sheet, the rotation speed of the paired folding rollers is controlled, so that the efficiency of the folding processing can be improved.

Incidentally, no limitation is made by the above description, and various modifications can be made within the scope not departing from the scope of claims. For example, a first variable speed mechanism 40 may be provided for the folding roller 37*a* and the discharge roller 39*a*, and a second variable speed mechanism 40 may be provided for the folding roller 37*b* and the discharging roller 39*b*.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet processing apparatus comprising:

a folding mechanism that includes paired folding rollers disposed along a transport path of a sheet, presses the sheet to a nip portion of the paired folding rollers from a direction orthogonal to a transport direction, and folds the sheet by rotating the paired folding rollers;

a variable speed mechanism that includes a drive motor rotatable in a first direction and a direction reverse to the first direction, and converts a rotation force of the drive motor into a rotation output in a single direction and with a low speed first rotation speed or a high speed second rotation speed by changing a rotation direction of the drive motor;

a transmission mechanism to transmit the rotation output of the variable speed mechanism in the single direction to the paired folding rollers and to rotation-control the paired folding rollers; and a control unit to control the rotation direction of the drive motor and to change a rotation speed of the paired folding rollers, wherein the variable speed mechanism includes:

a first gear rotated by rotation of the drive motor;

a lever rotated by a specified angle around a rotation shaft of the first gear in a rotation direction of the first gear;

a planetary gear attached to the lever and engaged with and rotated by the first gear;

a second gear engaged with and rotated by the planetary gear when the lever rotates in the first direction;

a reduction mechanism including a third gear engaged with and rotated by the planetary gear when the lever rotates in the direction reverse to the first direction, and a fourth gear engaged with and rotated by the third gear; and a fifth gear rotated by rotation of the second gear or the fourth gear, wherein the rotation output in the single direction is obtained based on rotation of the fifth gear.

2. A sheet processing apparatus for processing a sheet supplied from an image forming apparatus, comprising:

paired folding rollers disposed along a transport path of the sheet supplied from the image forming apparatus;

a blade disposed to be opposite to the paired folding rollers and to press the sheet to a nip portion of the paired folding rollers from a direction orthogonal to s transport direction;

paired discharging rollers to discharge the sheet folded by rotation of the paired folding rollers to a paper discharge tray;

a drive motor rotatable in a first direction and a second direction reverse to the first direction;

a variable speed mechanism in which the drive motor is a drive source, and a rotation direction of the drive motor is changed to convert a rotation force of the drive motor into a rotation output in a single direction and with a first rotation speed or a second rotation speed higher than the first rotation speed;

a transmission mechanism to transmit the rotation output of the variable speed mechanism in the single direction to the paired folding rollers and the paired discharging rollers, and to rotation-control the paired folding rollers and the paired discharging rollers; and a control unit to control the rotation direction of the drive motor and to change rotation speeds of the paired folding rollers and the paired discharging rollers.

3. The sheet processing apparatus according to claim 2, wherein the control unit controls the rotation direction of the drive motor, and when the sheet is subjected to a folding processing by the paired folding rollers, the rotation output with the first rotation speed is obtained from the variable speed mechanism, and after a folded point of the sheet passes through the paired folding rollers, the rotation output with the second rotation speed is obtained from the variable speed mechanism.

4. The sheet processing apparatus according to claim 2, wherein the control unit controls the rotation direction of the drive motor, and the rotation speeds of the paired folding rollers and the paired discharging rollers are changed in conjunction with each other.

5. The sheet processing apparatus according to claim 2, wherein the control unit controls the rotation direction of the drive motor, and when the rotation output with the second rotation speed is obtained from the variable speed mechanism, the paired discharging rollers are rotated in conjunction with the rotation speed of the paired folding rollers.

6. The sheet processing apparatus according to claim 2, further comprising a stapler to bundle a plurality of sheets transported from the image forming apparatus and to perform a staple processing, wherein a bundle of the sheets subjected to the stapling is folded by the paired folding rollers.

* * * * *